United States Patent [19]

Cantor et al.

[11] 4,017,407

[45] Apr. 12, 1977

[54] METHODS FOR PREPARING SOLID IODINE CARRIER MIXTURES AND SOLID FORMULATIONS OF IODINE WITH IODINE CARRIERS

[75] Inventors: Abraham Cantor, Elkins Park, Pa.; Murray W. Winicov, Flushing, N.Y.

[73] Assignee: West Laboratories, Inc., Long Island City, N.Y.

[22] Filed: Jan. 27, 1975

[21] Appl. No.: 544,412

Related U.S. Application Data

[63] Continuation-in-part of Ser. No. 360,338, May 14, 1973, Pat. No. 3,898,326.

[52] U.S. Cl. ..... 252/106; 252/89 R; 252/182; 424/80; 424/150

[51] Int. Cl.[2] ..... C11D 1/72; C11D 3/48

[58] Field of Search ..... 252/106, 89; 424/150, 424/80, 78; 260/88.3 L

[56] References Cited

UNITED STATES PATENTS

| | | | |
|---|---|---|---|
| 2,385,394 | 9/1945 | Witte | 424/150 |
| 2,706,701 | 4/1955 | Beller et al. | 424/150 |
| 2,739,922 | 3/1956 | Shelanski | 260/88.3 |
| 2,743,208 | 4/1956 | Marcuse et al. | 424/150 |
| 2,868,686 | 1/1959 | Shelanski et al. | 424/150 |
| 2,900,305 | 8/1959 | Siggia | 424/80 |
| 2,931,777 | 5/1960 | Shelanski et al. | 252/106 |
| 3,028,299 | 4/1962 | Winicov et al. | 424/150 |
| 3,028,300 | 4/1962 | Cantor | 424/150 |
| 3,028,427 | 4/1962 | Winicov | 260/567.6 |
| 3,089,818 | 5/1963 | Stone | 252/106 |
| 3,367,877 | 2/1968 | Cantor et al. | 252/106 |
| 3,687,855 | 8/1972 | Halpern | 252/106 |

*Primary Examiner*—P.E. Willis, Jr.
*Attorney, Agent, or Firm*—Howard E. Thompson, Jr.

[57] ABSTRACT

The improved approach to the direct formulation of solid iodine carriers containing poly (N-vinyl-2-pyrrolidone) and an iodide, as disclosed in copending application Ser. No. 360,338, has been extended to the direct formulation of solid products containing, in addition to the PVP and iodide, compatible additives such as nonionic detergent, anionic detergent, elemental iodine and mixtures thereof, as well as to the direct formulation of other solid iodine carriers.

14 Claims, No Drawings

METHODS FOR PREPARING SOLID IODINE CARRIER MIXTURES AND SOLID FORMULATIONS OF IODINE WITH IODINE CARRIERS

This application is in the nature of a continuation-in-part of our copending application Ser. No. 360,338 filed May 14, 1973, now Pat. No. 3,898,326 the disclosure of which is hereby incorporated in and made part of the present application.

In accordance with the present invention the improved approach to the direct formulation of solid iodine carriers containing poly (N-vinyl-2-pyrrolidone) and an iodide, as disclosed in said copending application Ser. No. 360,338, has been extended to the direct formulation of solid products containing, in addition to the PVP and iodide, compatible additives such as nonionic detergent, anionic detergent, elemental iodine and mixtures thereof, as well as to the direct formulation of other solid iodine carriers.

As disclosed in said copending application the solid PVP-iodide compositions are prepared by drying solutions containing the PVP and iodide in proper proportions to produce, e.g. cast solids, films, flakes, granules or powders of a free-flowing non-agglomerating nature. The drying is there described as accomplished in various ways as for example by evaporation and casting or grinding the resulting solid to desired particle size, by drum drying to produce a flake material, or by spray drying which characteristically leads directly to finely divided and free-flowing particles.

These powdered or particled PVP-iodide products are particularly useful in permitting the cold formulation of PVP-iodide-iodine compositions exhibiting enhanced iodine complexing in the solid state, by simple mechanical mixing of the PVP-iodide and elemental iodine at ambient temperature.

It has now been found, however, that if elemental iodine in the desired amount is incorporated in the aqueous PVP-iodide solution, and the solution dried to form particled or powdered solid product as above described, a further significant saving can be effected in the overall cost of producing powdered or particled PVP-iodide-iodine compositions. The ability of the iodide present in such a system to prevent iodine loss through volatilization during the drying stage was hardly to be expected, but surprisingly, even in the rather unusual conditions involved in spray drying it is found that the equipment is essentially free of iodine vapors.

In practicing this improved technique the materials and porportions thereof can be substantially as disclosed in said copending application Ser. No. 360,338. Thus the PVP can have a molecular weight of about 5,000 to 700,000, including without limitation K-15, K-30 and K-90 PVP. (The significance of K values to molecular weight and viscosity is disclosed in U.S. Pat. No. 2,706,701.) As the iodide component sodium iodide is preferred, but any water soluble source of iodide ion can be employed including potassium, lithium, magnesium, hydrogen, calcium, ammonium, amine, and quaternary ammonium iodides.

The proportions of PVP to $I^-$ should be in the range of about 1:1 to 20:1, and preferably about 2:1 to 6:1. It should be noted in this connection that throughout the specification and claims all amounts and proportions of iodide have reference to the iodide ion, and the expressions "iodide" and "$I^-$" are used interchangeably according to which expression best fits the particular context.

The amount of elemental iodine to be employed can vary from a trace to an amount approximately equal to the weight of PVP. For the disinfectant purposes the PVP-iodine ratio can be in the range of 1:1 to 20:1, and preferably in the range of about 2:1 to 10:1, and the ($I^-$)iodine ratio is preferably in the range of about 0.5:1 to 5:1.

While the solid PVP-iodide-iodine composition, whether prepared directly as above described, or by blending elemental iodine with the powdered PVP-iodide as in said copending application, can be used in preparing excellent germicidal solutions, particularly for topical therapeutic application when low toxicity and film forming properties characteristic of the PVP are desirable, there are other instances where it is desirable to impart wetting abnd detergent or cleansing action to such compositions. It has been customary, therefore, to provide modified PVP-iodine aqueous preparations in which compatible surfactants such as nonionic detergents and selected anionic detergents are present in amounts to provide the desired wetting or cleansing action. These additives, particularly in the case of the nonionic detergents can contribute significantly to the iodine carrying or complexing achieved in the overall composition.

It has now been found that such compatible additives can be incorporated in the starting PVP:iodide or PVP:iodide:iodine solutions so that upon drying to powdered or particled solid products as above described there is directly obtained a solid which combines the latent properties desired in end use solutions.

From the standpoint of general usefulness in germicidal compositions, as well as cost and availability, the following types of nonionic iodine carriers are of particular interest.

a. Nonionic carriers of the type disclosed in U.S. Pat. No. 2,759,869 and generally embraced by the formula:

$$HO\,(C_2H_4O)_x\,(C_3H_6O)_y\,(C_2H_4O)_{x'}\ \ -H$$

when $y$ equals at least 15 and $(C_2H_4O)_{x+x'}$ equals 20 to 90% of the total weight of said compound, and b. Nonionic carriers of the type disclosed in U.S. Pat. No. 2,931,777 and generally embraced by the formula:

$$,\ R\,(CH_2CH_2O)_x\,H$$

wherein R represents the residue of a water insoluble organic compound containing at least 6 carbon atoms and having an active hydrogen, and $x$ represents an integer within the range of 6 to about 100.

Nonionic carriers of the type shown in formula (a) above, also known as poloxamers, may be liquids, pastes, or solids depending on the molecular weights of the block polymers thereof. Preferred for use in formulations of the present invention are the solid poloxamers with proven low toxicity wherein the central polypropoxy (PPO) group has a molecular weight of about 1500 to 5000 and the combined polyethoxy (PEO) groups equals 70 to 90% of the total weight of the compound.

Typical poloxamers commercially available under the trademark "PLURONIC" include

| | | Approximate Mol. Wt. | % by Wt. |
|---|---|---|---|
| | | PPO | PEO |
| PLURONIC | F-68 | 1750 | 80% |
| PLURONIC | F-88 | 2250 | 80% |
| PLURONIC | F-98 | 2750 | 80% |
| PLURONIC | F-108 | 3250 | 80% |
| PLURONIC | F-127 | 4000 | 70% |

The solid poloxamers can be substituted for as much as about 50% of the PVP in the earlier mentioned PVP iodide and PVP-iodide-iodine compositions. In such new compounds the ratio of iodide and/or iodine to the PVP/poloxamer mixture will remain as earlier related to the PVP component.

It is also possible to use in combination with PVP limited amounts of lower molecular weight poloxamers, which may therefore be liquids or pastes. This restricts the substitution of liquid poloxamer to about 20 to 30% of the weight of PVP.

As the poloxamers are excellent iodine carriers, and much less expensive than PVP, it will be recognized that the mixed PVP/poloxamer solid products provide a substantial economic advantage while maintaining, particularly, with the higher molecular weight poloxamers, the favorable low toxicity which characterizes products in which PVP is the only iodine carrier.

Typical detergent additives embraced by formula (b) above include alkyl phenol-ethylene oxide condensates such as nonyl phenol condensed with 9 to 15 moles of ethylene oixde, ethoxylated alcohols, ethoxylated fatty acids, and the like. Solid ethoxylated detergents of this type can be added in an amount up to about 50% of the PVP, whereas the amount of a liquid ethoxylated detergent compatible in the sense of providing a non "sticky" solid product will generally be less than about 20% of the PVP.

Anionic detergents as additives to the PVP-iodide and PVP-iodide-iodine solid system fall in a different category than the nonionics as the anionics are generally poor iodine carriers but superior wetting and cleansing agents for some purposes. Thus compatible anionics such as alkylbenzenesulfonates and alkanoyl taurates can be added in substantial amount, generally up to the amount of PVP in the system, without the need for altering the PVP:iodide and PVP:iodine ratios.

The foregoing procedures provide special advantages and economics when the starting PVP is in aqueous solution, as when it has been diverted from normal PVP production prior to the final drying step. When the PVP or another starting component is not in aqueous solutions, however, it has been found that solid carrier mixtures which also provide the advantage of permitting iodine complexing by simple mixing at ambient temperature can be prepared by an alternate and essentially anhydrous procedure. This alternate procedure involves combining desired components at elevated temperature with at least one of the components in the molten state and then converting the homogeneous mixture to a desired solid particle state by spray chilling or cooling and flaking. The PVP in the mixed system containing molten poloxamer and PVP is uniformly distributed.

Practical combined solid iodine carriers that can be formulated in this way using solid, meltable nonionic carrier include:

Nonionic carrier plus PVP
Nonionic carrier plus iodide
Nonionic carrier plus preformed PVP-iodide
Nonionic carrier plus PVP plus iodide.

Preferred nonionic carriers for this purpose are the earlier described solid poloxamers having melting points substantially above room temperature.

The improved procedures for formulating solid iodine carrier compositions and carrier-iodine complexes will be more fully understood from a consideration of the following Examples, but it is to be understood that these Examples are given by way of illustration and not of limitation.

Example I

| | Parts by Weight | | | | | |
|---|---|---|---|---|---|---|
| | PVP K-30 | NaI | Pluronic F-127 | Pluronic F-68 | Anionic Detergent | Total Solids |
| A | 3.0 | 1.8 | 0.5 | — | — | 20% |
| B | 3.0 | 1.2 | — | 3.0 | — | 20% |
| C | 3.0 | 1.8 | — | — | — | 21% |
| D | 3.0 | 1.2 | — | — | — | 21% |
| E | 3.0 | 1.2 | — | 2.5 | 0.5* | 20% |
| F | 3.0 | 1.2 | — | 2.0 | 1.0** | 20% |

* sod. dodecylbenzene sulfonate, 95% act.
** sod. salt cocoyl taurate, 95% act.

These solutions were spray dried under conditions providing the following pertinent date.

| | Inlet Temp. | Outlet Temp. | Moisture % |
|---|---|---|---|
| A | 200° C | 115° C | 1.7 |
| B | 180° C | 90° C | 2.1 |
| C | 190° C | 110° C | 0.9 |
| D | 190° C | 110° C | 1.8 |
| E | 195° C | 105° C | 1.2 |
| F | 195° C | 110° C | 1.4 |

These products, all white to slightly yellow powders, have the following approximate compositions (disregarding the traces of moisture) expressed in percent by weight.

| | A | B | C | D | E | F |
|---|---|---|---|---|---|---|
| PVP K-30 | 56.6% | 41.7% | 62.5% | 71.4% | 41.7% | 41.7% |
| NaI | 34.0% | 16.6% | 37.5% | 38.6% | 16.6% | 16.6% |
| F-127 | 9.4% | — | — | — | — | — |
| F-68 | — | 41.7% | — | — | 34.7% | 27.8% |
| Anionic | — | — | — | — | 7.0% | 13.0% |

These iodide products were then combined with powdered iodine by rolling in large glass jars at room temperature for 3 hours, thereby complexing the iodine. The amount of iodine used in each complex (A-I, B-I, etc.) is shown in the following table:

| Component | A-I Parts % | B-I Parts % | C-I Parts % | D-I Parts % | E-I Parts % | F-I Parts % |
|---|---|---|---|---|---|---|
| Powd. | 1.15 | 1.1 | 1.15 | 1.1 | 1.1 | 1.1 |
| Iodine | 17.8% | 13.2% | 19.3% | 20.8% | 13.2% | 13.2% |
| A | 5.30 82.2% | — | — | — | — | — |
| B | — | 7.2 86.8% | — | — | — | — |
| C | — | — | 4.80 | — | — | — |

-continued

| Component | A-I Parts % | B-I Parts % | C-I Parts % | D-I Parts % | E-I Parts % | F-I Parts % |
|---|---|---|---|---|---|---|
| | | | 80.7% | | | |
| D | — | — | — | 4.2 | — | — |
| | | | | 79.2% | | |
| E | — | — | — | — | 7.2 | — |
| | | | | | 86.8% | |
| F | — | — | — | — | — | 7.2 |
| | | | | | | 86.8% |

For products A, C and D, the complexing of iodine appeared completed before the end of the 3-hour mixing.

Product B, containing the lower molecular weight poloxamer Pluronic F-68, approaches the limit of practicability. At the end of 3-hour mixing the unevenness of color indicated incomplete or uneven complexing. After mixing for an additional 3 hours, however, the product B-I was of uniform color and appearance and was a satisfactory product.

Products E and F required mixing beyond the initial 3 hours, but the complexing of iodine appeared to be completed midway of a second 3-hour mixing period.

The iodine complexes were tested for titratable iodine at room temperature shortly after preparation, and after storage in closed containers at elevated temperatures for different periods with the following results:

| Iodine Complex | Per Cent Titratable Iodine "Theory" | Found | 50° C 1 Day | 50° C 1 Week | 50° C 2 Weeks |
|---|---|---|---|---|---|
| A-I | 17.8% | 17.2% | 17.1% | 17.1% | 17.1% |
| B-I | 13.2% | 13.3% | 12.7% | 12.6% | 12.5% |
| C-I | 19.3% | 18.6% | 18.6% | 18.6% | 18.6% |
| D-I | 20.8% | 20.4% | 20.4% | 20.4% | 20.4% |
| E-I | 13.2% | 13.1% | 12.9% | 12.8% | 12.7% |
| F-I | 13.2% | 13.1% | 12.9% | 12.7% | 12.6% |

The iodine stability was satisfactory in all the cases. There was no significant difference between the iodine stability of the compositions containing detergent and the controls. None of the six products, A-I to F-I, gave a starch paper test before drying out, under conditions as described in said copending application, Ser. No. 360,338. The PVP/Polxamer combination was therefore apparently as effective as the PVP alone in complexing iodine.

None of the six products dissolved to any significant extent in chloroform. In this way, also the PVP/poloxamer compositions were equal to the compositions based on PVP alone.

EXAMPLE II

An aqueous solution containing 19.7% by weight PVP, 2,3% NaI (providing 1.9% $I^-$) and 1.8% elemental iodine was passed through a spray dryer at inlet temperature 190° C and outlet temperature of about 110° C. This was done as the final run of the day anticipating that iodine vapors might contaminate the equipment. Surprisingly, no iodine vapors were observed in the spray drum or out the exhaust stack, and the product obtained was a fine, free-flowing powder. By analysis it showed 7.7% titratable iodine and 16.1% total iodine, very close to the theoretical calculated amounts, confirming that the iodine loss in spray drying, if any, was only a trace.

Without the iodide being present such spray drying is impossible owing to the release of purple iodine vapors. It has been determined in other tests if the iodide:iodine ratio is at least 0.4:1, and preferably in the range of 0.4:1 to 1:1, the release of iodine vapors in spray drying prevented. Additional iodide would be of no significance in the spray drying process but would not be objectionable if the properties desired in the carrier-iodine complex called for a higher iodide:iodine ratio.

EXAMPLE III

A germicidal solution is prepared in the form of a concentrate intended at appropriate further dilution for sanitizing equipment by disolving in about 90 ml. of water, 6.45 parts by weight of iodine complex A-I as described in Example II and 0.45 parts by weight of citric acid, neutralizing to pH 5.5 with 48% by weight NaOH solution, and adjusting the total water to provide:

| | by weight |
|---|---|
| Iodine Complex A-I | 6.45% |
| Citric acid | 0.45% |
| NaOH (48% by wt.) | 0.44% |
| Water | to 100% |

The indicated amount of iodine complex A-I actually provides by weight 3.0% PVP, 1.8% NaI, 0.5% Pluronic F-127 and 1.15% elemental iodine.

This composition was found to be identical with a composition containing the same amounts of all ingredients but prepared in the conventional way by combining the individual ingredients in water, but it will be apparent that the use of iodine complex A-I has greatly simplified the formulating procedure.

EXAMPLE IV

A germicidal solution intended for use as a topical antiseptic, without further dilution, is prepared by disolving in water amounts of the iodine complex B-I as described in Example II and sodium citrate to provide:

| | by weight |
|---|---|
| Iodine complex B-I | 8.30% |
| Sodium citrate $2H_2O$ | 1.20% |
| Water | to 100% |

The indicated amount of iodine complex B-I actually provides by weight 3.0% PVP, 3.0% Pluronic F-68, 1.2% NaI, and 1.1% of elemental iodine. This composition has a pH of 6.5, appropriate for the intended topical use.

This composition is identical with a composition prepared by separately introducing the same amount of each ingredient to an aqueous medium, but it will be apparent that the use of iodine complex B-I has greatly simplified manufacturing and quality control procedures.

EXAMPLE V

One hundred parts of Pluronic F-68 was heated to 80° C and stirred throughly while 50 parts of K-30 PVP was added. The mixture was stirred for 1 hour at this temperature and then allowed to cool. The resulting product, containing approximately 33% PVP and 67% Pluronic F-68 was flaked. The melting point was found to be 53° C. Ten parts of the flaked mixture were combined with one part of powdered iodine by rolling in a ceramic ball mill for 8 hours at 10° C. At the end of this time the iodine crystals had disappeared. The poloxamer/PVP/iodine mixture analyzed 8% titratable iodine, and disolved readily in water to yield aqueous solutions containing poloxamer, PVP and iodine in the approximate ratio of 8:4:1.

EXAMPLE VI

Ninety parts of Pluronic F-68 was heated to 80° C and stirred thoroughly while 50 parts of K-30 PVP and 10 parts of sodium cocoyl taurate (95% active) were added. The mixture ws stirred for 1 hour at this temperature and then allowed to cool. The resulting product, containing approximately 33% PVP, 7% sodium cocoyl taurate, and 60% Pluronic F-68 was flaked. The melting point was found to be 53° C. Ten parts of the flaked mixture were combined with one part of powdered iodine by rolling in a ceramic ball mill for eight hours at 10° C. At the end of this time the iodine crystals had disappeared. The poloxamer/PVP/anionic detergent/iodine mixture analyzed 8% titratable iodine, and dissolved readily in water to yield aqueous solutions containing poloxamer, PVP, anionic detergent, and iodine in the approximate ratio of 7:4:1:1.

EXAMPLE VII

One hundred parts of Pluronic F-68 was heated to 80° C and stirred thoroughly while 100 parts of a PVP-sodium iodine spray-dried mixture (62.5% K-20 PVP, 37.5% NaI) was added. The mixture was cooled, flaked, and combined with iodine as in Example V, eventually yielding a composition with poloxamer, PVP, iodide and iodine in the approximate proportions of 6:4:2:1. While the mixing in the ball mill was continued for 8 hours as in Example V, no charge was noted, and complexing appeared to be complete after five hours of mixing.

EXAMPLE VIII

One hundred parts of Pluronic F-68 was heated to 80° C and stirred thoroughly while 20 parts of powdered sodium iodide was added. The mixture was cooled, flaked, and combined with iodine as in Example V, eventually yielding a composition with Pluronic F-68, iodide and iodine in the proportions of about 10:1.5:1. While the mixing in the ball mill was continued for eight hours as in Example V, no charge was noted, and complexing appeared to be complete, after 5 hours of mixing.

EXAMPLE IX

One hundred parts of Pluronic F-68 was heated to 80° C and stirred thoroughly while ten parts of 47% aqueous hydrogen iodide was added. The mixture was cooled, flaked, and combined with iodine as in Example V, eventually yielding a composition with Pluronic F-68, iodide and iodine in the proportions of about 10:0.5:1. While the mixing in the ball mill was continued for eight hours as in Example V, no charge was noted, and complexing appeared to be complete, after 5 hours of mixing.

Various charges and modifications in the formulation of iodine complexes as herein described may occur to those skilled in the art, and to extent that such changes and modifications are embraced by the appended claims it is to be understood that they constitute part of the present invention.

We claim:

1. The solid PVP-iodide product obtained by first preparing an aqueous solution of poly (N-vinyl-2-pyrrolidone), a water soluble iodide selected from the group consisting of sodium, potassium, lithium, magenesium, hydrogen, calcium, ammonium, amine and a quaternary ammonium iodides, and a compatible additive selected from the group consisting of nonionic detergents and mixtures thereof in proportions to provide a (PVP plus nonionic detergent): $I^-$ ratio in the range of about 1:1 to 20:1, the amount of nonionic detergent not exceeding the amount of PVP, and drying said aqueous solution and particalizing the resulting solid to obtain a product in which individual particles contain the PVP, iodide and additive in homogeneous mixture.

2. A solid PVP-iodide nonjonic detergent product as defined in claim 1 wherein the nonionic detergent is a poloxamer of the formula:

$$HO(C_2H_4O)_x(C_3H_6O)_y(C_2H_40)_x \quad -H$$

where $y$ equals at least 15 and $(C_2H_4O)x+x'$ equals 20 to 90% of the total weight of said compound,

3. A solid PVP-iodide monionic detergent product as defined in claim 2 wherein the poloxamer is one in which the molecular weight of $(C_3H_6O)_y$ is in the range of about 1500 to 5000 and the groups $(C_2H_40)_x+_x'$ constitute 70 to 90% of the total weight of said poloxamer.

4. A solid PVP-iodide nonionic detergent product as defined in claim 1 wherein the nonionic detergent is a compound of the formula:

$$R(CH_2CH_2O)_xH$$

wherein R represents the residue of a water insoluble organic compound containing at least 6 carbon atoms and having an active hydrogen, and $x$ represents an integer within the range of 6 to about 100,

5. A solid PVP-iodide product as defined in claim 1 wherein drying and particalizing is effected simultaneously by spray drying said aqueous solution, and said product is a free-flowing powder.

6. A solid PVP-iodide product as defined in claim 1, wherein the starting solution also contains as additive an amount of anionic detergent selected from the group consisting of alkylbenzenesulfonates and alkanoyl taurates sufficient to provide wetting or cleansing action but not exceeding the amount of PVP.

7. A solid PVP-iodide product as defined in claim 6, wherein the starting aqueous solution also contains as compatible additive an amount of elemental iodine to provide a PVP:iodine ratio in the range of about 1:1 to 20:1 and an $(I^-)$ :iodine ratio in the range of about 0.5:1 to 5:1.

8. A solid PVP-iodide product as defined in claim 1 wherein the starting aqueous solution also contains as compatible additive an amount of elemental iodine to provide a PVP:iodine ratio in the range of about 1:1 to 20:1 and an $(I^-)$ : iodine ratio in the range of about 0.5:1 to 5:1.

9. A solid iodine complexing product consisting essentially of a homogeneous mixture of a solid poloxamer of the formula:

$$HO(C_2H_4O)_x(C_3H_6O)_y(C_2H_4O)_{x'} \quad -H$$

wherein the molecular weight of $(C_3H_6O)_y$ is in the range of 1500 to 5000 and the amount of $(C_2H_4O)_{x+x'}$ equal 70 to 90% of the total weight of said poloxamer, and as an additive assisting in the carrying of iodine poly (N-vinyl-2-pyrrolidone) in an amount to provide a weight ratio of PVP:poloxamer of about 0.5:1 to 1:1, said homogeneous mixture being obtained by first melting said poloxamer, uniformly mixing the additive into the melt and particalizing the resulting mixture by spray chilling or cooling and flaking to provide a solid product capable of rapid room temperature complexing with elemental iodine.

10. A solid iodine complexing product consisting essentially of a homogeneous mixture of a solid poloxamer of the formula:

$$HO(C_2H_4O)_x(C_3H_6O)_y(C_2H_4O)_{x'} \quad -H$$

wherein the molecular weight of $(C_3H_6O)_y$ is in the range of 1500 to 5000 and the amount of $(C_2H_4O)_{x+x'}$ equal 70 to 90% of the total weight of said poloxamer, and as an additive assisting in the carrying of iodine a water soluble iodide selected from the group consisting of sodium, potassium, lithium, magnesium, hydrogen, calcium, ammonium, amine, and quaternary ammonium iodides in an amount to provide the iodide ($I^-$) equivalent of a 1:5 to 3.6:1 weight ratio of sodium iodide:poloxamer, said homogeneous mixture being obtained by first melting said poloxamer, uniformly mixing the additive into the melt and particalizing the resulting mixture by spray chilling or cooling said flaking to provide a solid product capable of rapid room temperature complexing with elemental iodine.

11. A solid iodine complexing product consisting essentially of a homogeneous mixture of a solid poloxamer of the formula:

$$HO(C_2H_4O)_x(C_3H_6O)_y(C_2H4O)_{x'} \quad -H$$

wherein the molecular weight of $(C_3H_6O)_y$ is in the range of 1500 to 5000 and the amount of $(C_2H_4O)_{x+x'}$ equal 70 to 90% of the total weight of said poloxamer, and as an additive assisting in the carrying of iodine a mixture of poly (N-vinyl-2-pyrrolidone) and a water soluble iodide selected from the group consisting of sodium, potassium, lithium, magnesium, hydrogen, calcium, ammonium, amine, and quaternary ammonium iodides, said additive having a PVP:$I^-$ratio in the range of 1:1 to 20:1, the weight of said additive not exceeding the weight of said poloxamer, said homogeneous mixture being obtained by first melting said poloxamer, uniformly mixing the additive into the melt and particalizing the resulting mixture by spray chilling or cooling and flaking to provide a solid product capable of rapid room temperature complexing with elemental iodine.

12. A solid iodine complexing product as defined in claim 11, wherein said additive mixture is a preformed, particled solid.

13. The process for preparing a PVP-iodide-iodine product that comprises first preparing an aqueous solution of poly (N-vinyl-2-pyrrolidone), and a water soluble iodide selected from the group consisting of sodium, potassium, lithium, magnesium, hydrogen, calcium, ammonium, amine and quaternary ammonium iodides in amount to provide a PVP : ($I^-$) ratio in the range of about 1:1 to 20:1, adding elemental iodine to said solution in an amount to provide a PVP:iodine ratio in the range of about 1:1 to 20:1 and an ($I^-$) : iodine ratio in the range of about 0.5:1 to 5:1, and drying said aqueous solution and particalizing the resulting solid to obtain a product in which individual particles contain PVP, iodide and iodine in homogeneous mixture.

14. The process as defined in claim 13 wherein drying and particalizing is effected simultaneously by spray drying said aqueous solution, and said product is a free flowing powder.

* * * * *